United States Patent [19]

Focke et al.

[11] Patent Number: 4,617,974

[45] Date of Patent: Oct. 21, 1986

[54] APPARATUS FOR PACKAGING TOBACCO PORTIONS

[75] Inventors: Heinz Focke; Oskar Balmer, both of Verden, Fed. Rep. of Germany

[73] Assignee: Focke & Co., (GmbH & Co.), Verden, Fed. Rep. of Germany

[21] Appl. No.: 700,163

[22] Filed: Feb. 11, 1985

[30] Foreign Application Priority Data

Mar. 14, 1984 [DE] Fed. Rep. of Germany ..... 3409263

[51] Int. Cl.[4] ..... B65B 1/04

[52] U.S. Cl. ..... 141/239; 198/442

[58] Field of Search ..... 141/10, 237, 239, 243; 198/442; 222/264, 270, 274, 276, 277

[56] References Cited

U.S. PATENT DOCUMENTS

| | | | |
|---|---|---|---|
| 744,175 | 11/1903 | Dedreux | 222/274 |
| 1,389,060 | 8/1921 | Lippitz | 222/274 X |
| 2,036,421 | 4/1936 | Luckie | 198/442 X |
| 2,047,214 | 7/1936 | McJoynt | 141/10 |
| 4,051,964 | 10/1977 | Meijer | 198/442 X |

FOREIGN PATENT DOCUMENTS

| | | | |
|---|---|---|---|
| 66410 | 2/1948 | Denmark | 222/270 |

*Primary Examiner*—Stephen Marcus
*Assistant Examiner*—Mark Thronson
*Attorney, Agent, or Firm*—Sughrue, Mion, Zinn, Macpeak, and Seas

[57] ABSTRACT

To increase the efficiency of a packaging machine for tobacco portions (10) without adversely affecting the tobacco, two or more tobacco portions (10) are supplied to a packaging turret (11) at the same time. The tobacco portions (10) supplied individually, for example by a bucket chain (13), are collected in cells of a collector formed of two star feeders (32, 33), until the number of tobacco portions corresponding to the simultaneous packaging requirement is available. A distributor (22) with portion receiving chambers is located in front of the collector to sequentially receive tobacco portions.

6 Claims, 5 Drawing Figures

APPARATUS FOR PACKAGING TOBACCO PORTIONS

DESCRIPTION

Figure 1:
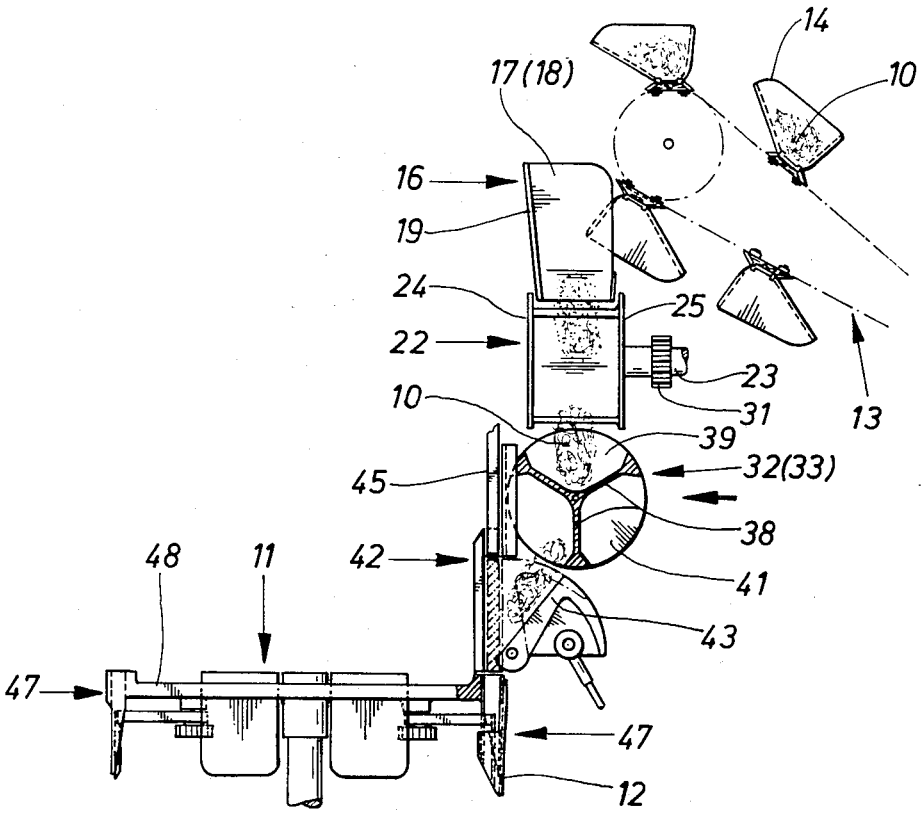

The invention relates to a process for packaging measured portions of fibrous material, especially cut tobacco, in which the portions are supplied in succession to a packaging machine or to a packaging turret of the latter and are filled into bag packs or the like.

Furthermore, the invention relates to an apparatus for packaging measured portions, especially tobacco portions, in which the portions are supplied in succession to a packaging machine by means of a conveyor and can be filled into bag packs in the region of a packaging turret or the like.

A tobacco balance is usually located in front of packaging machines for cut tobacco, to form individual tobacco portions of exact size. These are then supplied to the packaging machine by means of a conveyor, predominantly by means of a bucket chain. The portions are predominantly filled into bag packs (rolled bags or side-fold1ng bags).

The capacity of the packaging machine depends on the filling cycles which can be executed per unit time. A limitation arises because the tobacco portions are conveyed with their own weight being utilized.

The object on which the invention is based is to increase the efficiency of the packaging machine or of a packaging turret assigned to the latter, without the tobacco of the individual portions being adversely damaged (mechanically) as a result of, for example, increased speed of the conveying or other members.

To achieve this object, the process according to the invention is defined in that at least two portions of the fibrous material are fed to the packaging machine or to the packaging turret at the same time. This produces a considerable increase in capacity, without the members involved moving at increased speed.

Since the portions are supplied, arriving individually from the tobacco balance, to the packaging machine, a further essential feature of the invention is that the portions are collected before transfer to the packaging turret, in such a way that two or more portions are supplied to the packaging machine or to the packaging turret at the same time.

An apparatus according to the invention for carrying out the process is equipped with one or more collectors for receiving the portions temporarily, specifically, in particular, in a design as rotatable star feeders. The portions are supplied to the collector or collectors in succession. When two or more portions are present, these are delivered simultaneously by the collector, to be conveyed further to the packaging turret.

The portions are supplied to the collector by a distributor member designed in a special way, which itself receives the portions from a conveyor or a funnel assigned to the latter. The distributor member consists of a rotatably driven chamber wheel with at least two chambers, each for receiving one portion. The provision of a transverse wall and a radial wall for limiting the chambers guarantees that, at any particular time, one chamber is in the receiving position for one portion and the other chamber is in the delivery position to one of two star feeders of the collector. The chamber wheel is pivoted alternately in opposite directions along an arc of a circle.

Further features of the invention relate to the design and arrangement of the distributor member, collector and connected conveying and handling members for the portions.

Figure 2:
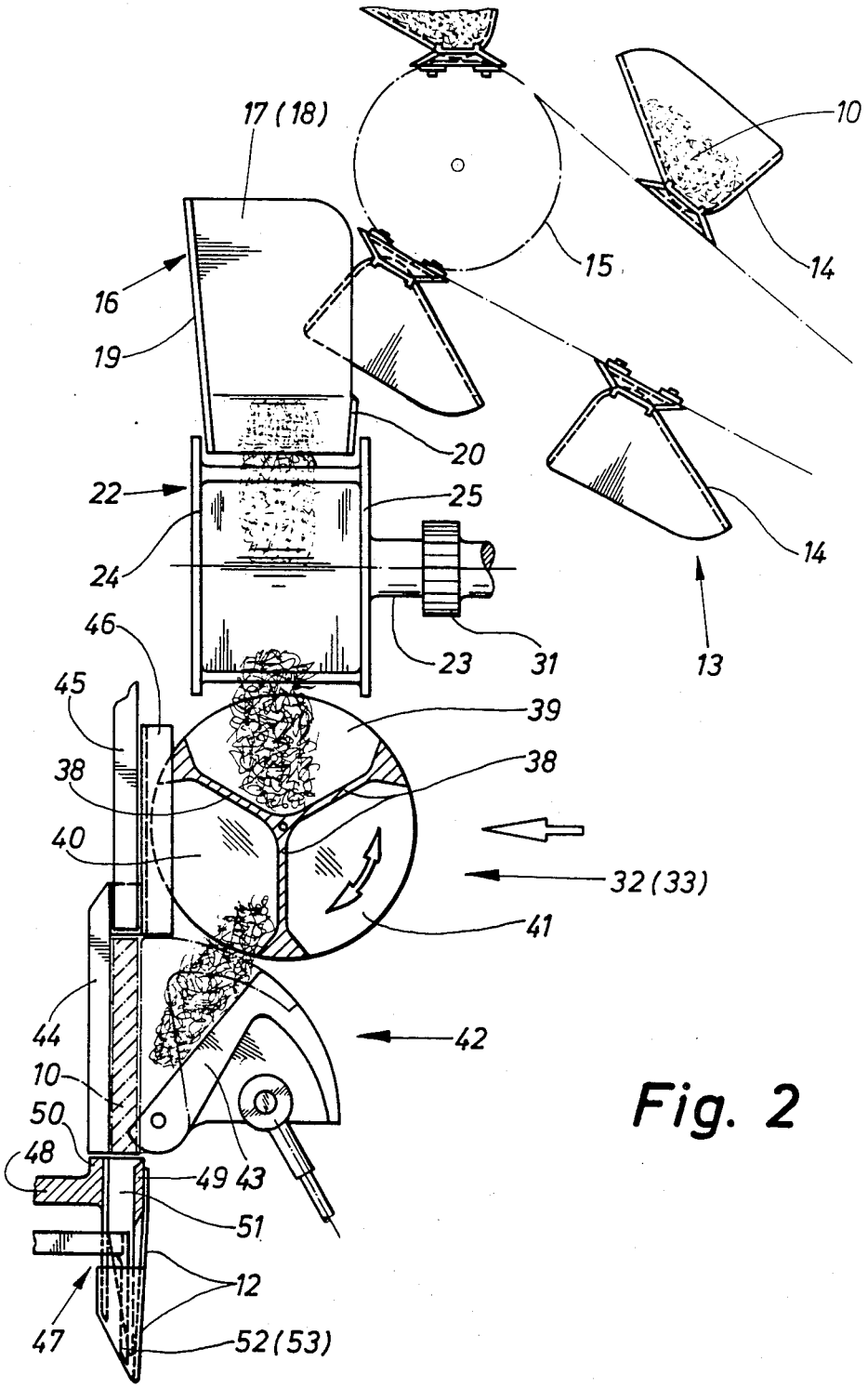
Figure 3:
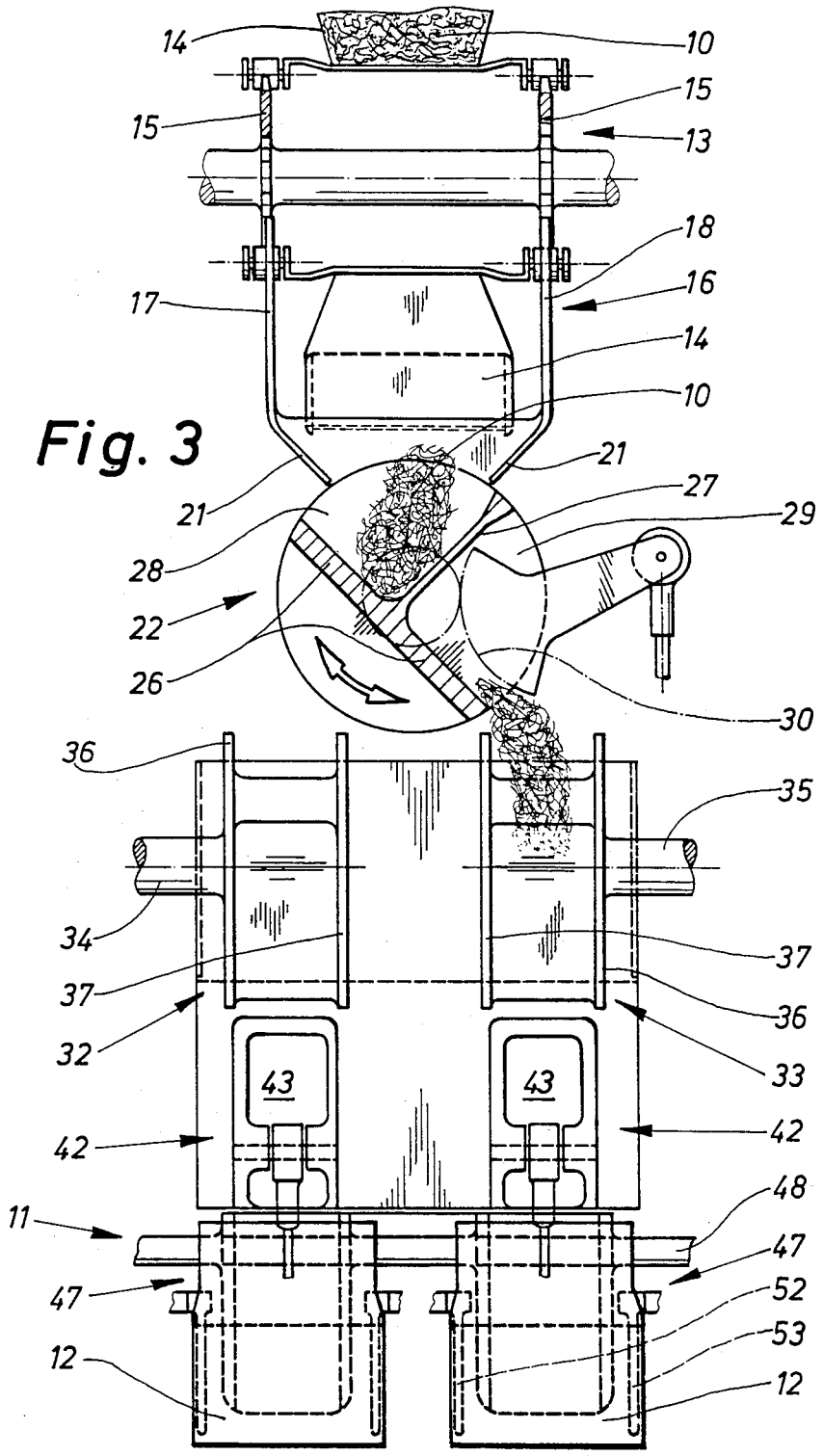
Figure 4:
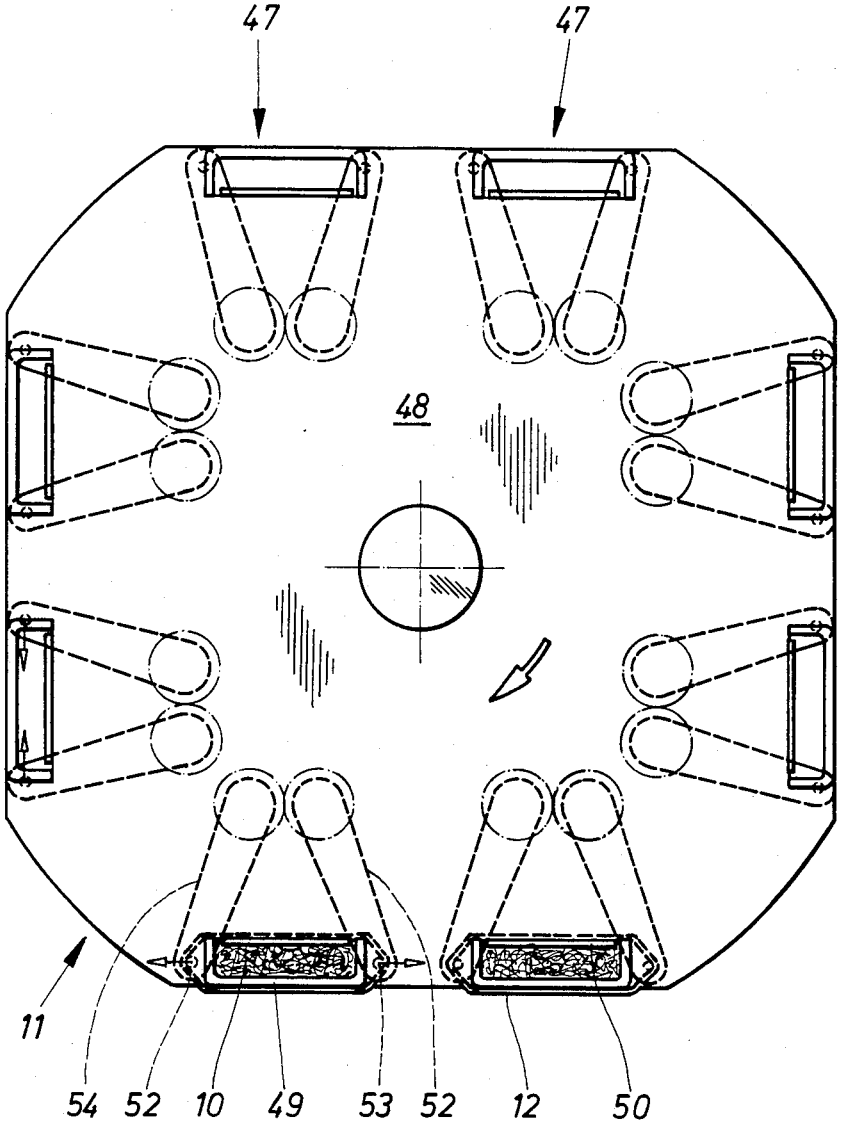
Figure 5:
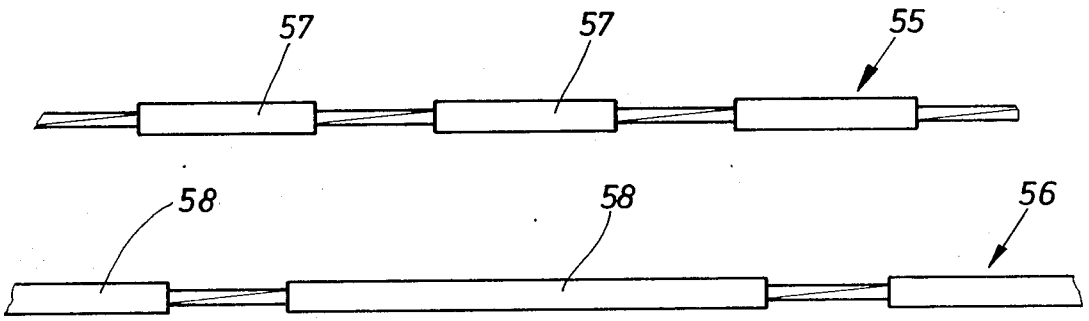

An exemplary embodiment of the apparatus according to the invention is explained in more detail below with reference to the drawings in which:

FIG. 1 shows the relevant part of the apparatus, partially in section, in a diagrammatic side view, FIG. 2 shows an (upper) part of the apparatus according to FIG. 1 on an enlarged scale, FIG. 3 shows a front view of the apparatus or details of the latter shown in FIG. 2, offset 90°, FIG. 4 shows, in a diagrammatic horizontal projection, a filling or packaging turret for bag packs, FIG. 5 shows diagrams illustrating the time pattern of movement sequences.

The apparatus illustrated in the drawings is mainly intended for the packaging of tobacco portions 10. It is accordingly a (preceding) part of a packaging machine, of which a packaging turret 11 is shown diagrammatically in FIG. 1. The tobacco portions 10 are to be filled into bag packs 12 known as rolled bags or side-folding bags.

The tobacco portions 10 of exact dimensions arrive from a tobacco balance which is especially of the design shown in West German Patent Application No. P 32 26 654.5. The tobacco balance is connected to the packaging machine via a conveyor, in the present case via a bucket chain 13. A bucket 14 serves for receiving each tobacco portion 10.

In the region of a deflection in the bucket chain 13 (deflecting wheel 15), the tobacco portions 10 are thrown down, specifically into a funnel 16, as a result of tilting of the buckets 14. This funnel consists, at least in the upper region, of two side walls 17, 18 located opposite one another and of a rear wall 19. On the side located opposite the latter, the funnel 16 is essentially open, so that the buckets 14 can pass partially through the interior of the funnel 16. A front wall 20 of low height is formed in the lower region.

Connected underneath the funnel 16, in particular immediately following converging extensions 21 of the side walls 17, 18 of the funnel, is a distributor member 22. In the present case, this consists of a chamber wheel which is mounted rotatably, in particular at the end of a drive shaft 23. The chamber wheel is formed by lateral disks 24 and 25, circular in the present case, and a chamber partition arranged between these and taking the form of a transverse wall 26, as well as by a radial wall 27 which is arranged centrally on the latter and which extends at right angles to the transverse wall. The transverse wall 26 and radial wall 27, in conjunction with the lateral disks 24, 25, produce two portion chambers 28 and 29 which are open on the radially outer side.

The distributor member 22 designed in this way is arranged underneath the funnel 16, in such a way that in each of the two end positions, one of which is shown in FIG. 3, one of the portion chambers faces the funnel 16 with its open side, whilst the other portion chamber is in an emptying position, in each case with the transverse wall 26 being inclined. As is evident from FIG. 3, the full width of the open side of the portion chamber 28 (in the peripheral direction) is ready for receiving a tobacco portion 10. At the same time, in the region of the other portion chamber 29 the transverse wall 26 is directed downwards, so that the tobacco portion 10 received in this portion chamber 29 can slide out under its own weight.

The distributor member 22 or the drive shaft 23 is driven to rotate to and fro via a pivotably driven toothed segment 30 in conjunction with a pinion 31 on the drive shaft 23. The amount of movement is approximately 90°.

Located underneath the distributor member 22 is a collector, in particular a device which receives several tobacco portions 10 in succession and which then conveys them further at the same time. In the present exemplary embodiment, two star feeders 32 and 33 are mounted rotatably on the same axis, specifically with the axes of rotation transverse to the axis of rotation of the distributor member 22. Each star feeder rests on a shaft end 34 and 35. Furthermore, a separate drive is assigned to each star feeder 32, 33. However, rotation takes place simultaneously during "normal operation".

The star feeders 32, 33 each consist of two side walls 36 and 37, each in the form of a circular disk. Three partition walls 38 arranged radially in the form of a star are formed between these side walls. Because the particular walls 38 are distributed at equal angular distances from one another, individual cells 39, 40, 41 having the dimension in the peripheral direction of approximately 120° are obtained for each star feeder, the individual cells of one star feeder being paired with a cell of the other star feeder. The rotary drive of the star feeders 32, 33 is controlled so that one of the cells 39, 40, 41 is always directed upwards, in such a way that the full free open peripheral side is assigned to the distributor member 22. In the view according to FIG. 3, the star feeders 32, 33 are arranged offset relative to the center plane of the distributor member 22, in such a way that the particular portion chamber (28 in FIG. 3) which is in the emptying position empties exactly into one of the cells 39, 40, 41 of one star feeder 32, 33 or the other.

The rotary movement of the star feeders 32, 33 is controlled so that a shift through 120°0 takes place only when both star feeders 32, 33 have been charged with a tobacco portion 10. The star feeders 32, 33 then rotate simultaneously in an anti-clockwise direction in the illustration according to FIG. 2. The respective cell thereby moves into an emptying position (the cell 40 in FIG. 2). The tobacco portion 10 slides out of the particular cell 40 under its own weight.

In the present example, there is underneath the particular cell 40 a press chamber 42, into which the tobacco portion slides in the opening position of the latter. The press chamber 42 consists, in a way known per se, of a pivotable press wall 43 and a vertical fixed opposing wall 44 arranged at a distance from the latter. In the vertical pressing position of the press wall 43, an inner space is enclosed by means of the opposing wall 44, and in this the tobacco portion 10 is pressed into a rectangular slab-shaped structure.

The tobacco portion 10 formed in this way is pushed out of the press chamber 42 downwards, in the present case by means of a slide 45 movable up and down on a guide 46. The movement of the slide 45 is selected so that the pressed tobacco portion 10 enters the bag pack 12, kept ready underneath the press chamber 42, in the region of a pocket 47 of the packaging turret 11.

The packaging turret 11 shown diagrammatically in FIG. 4 consists of a plate 48 rotating about a vertical axis. The pockets 47 are arranged in pairs at the edge of this plate and each consists of a U-shaped outer wall 49 and an inner wall 50 located between the legs of the latter. The outer wall 49 and inner wall 50 delimit a pocket orifice 51.

The bag pack 12 with the bag part for receiving the tobacco portion 10, underneath the pocket 47 designed in the way described above. In this region there are also spreader members for the bag pack 10, in particular essentially vertical spreader pins 52 and 53. These penetrate from above into the open bag part of the bag pack 12 and spread the latter. For this purpose, the spreader pins 52, 53 are arranged on pivoting levers 54. As is evident from FIG. 2, the inner wall 50 and part of the outer wall 49 are prolonged downwards, so that they extend into the bag part of the bag pack 12 and spread this in the radial direction. It is thereby possible to push the pressed tobacco portion 10 unimpeded through the pocket orifice 51 into the bag part of the bag pack 12.

As shown, the star feeders 32, 33, can be driven in both directions of rotation. Rotation counter to the "normal direction", in particular in a clockwise direction, occurs when there is no bag pack 12 or only one bag pack 12 made available because of any fault which may have arisen in the region of the packaging turret 11. The movement sequences are in this case maintained. The tobacco portion received in the region of the collector (star feeders 32, 33) are conveyed out of the path of movement as a result of appropriate rotation of the star feeders 32, 33 and are intercepted. The distributor member 22 is consequently driven continuously in the way described, irrespective of whether tobacco portions 10 have been supplied or whether the packaging turret 11 is ready to receive them.

FIG. 5 shows a diagram illustrating the movement sequences. One diagram strip 55 shows the movement sequences of the distributor member 22. A diagram strip 56 underneath it shows the corresponding movements of the star feeders 32, 33. The blank rectangles 57 and 58 indicate the standstill phases of the respective members. The standstill phase of the star feeders 32, 33 is accordingly longer than a standstill phase and two movement phases of the distributor member 22.

We claim:

1. Apparatus for packaging measured portions of fibrous material into bags, comprising:

a packaging machine including a packaging turret having a plurality of pockets (46) each containing a bag to be filled with one of said measured portions; a conveyor for sequentially feeding said measured portions to said packaging machine;

star feeder means containing a plurality of pairs of cells, each cell sized to temporarily store a measured portion of said material;

means for causing at least two measured portions of said material to be simultaneously transferred from two cells of one of said pairs of cells to two of said bags;

distributor means (22), arranged upstream of said star feeder means in the direction of material flow through said packaging apparatus, for sequentially transferring one measured portion and then another to said one of said pairs of cells, said distributor means comprising at least two portion chambers (28, 29), each of said portion chambers being positionable to receive a measured portion of said material from said conveyor; said portion chambers being arranged such that when one of said at least two portion chambers is positioned to receive a measured portion of said material from said conveyor, the other of said at least two portion chambers is positioned to discharge a measured portion stored therein to a cell of a cell pair and when the other of said at least two portion chambers is positioned to receive a measured portion from said conveyor, the one of said portion chambers is positioned to discharge a measured portion stored therein to the other cell of said cell pair; and means for reciprocally moving said at least two portion chambers between a measured portion receiving position and a measured portion discharge position.

2. The apparatus according to claim 1, wherein said star feeder means is comprised of two star feeders (32, 33), each one containing a plurality of cells, each cell of one star feeder being paired with a cell of the other star feeder, and said means for causing simultaneous transfer comprising means for simultaneously rotating said two star feeders causing the measured portions in paired cells to simultaneously discharge to respective bags in pockets of said packaging turret only after said paired cells have both received a measured portion.

3. The apparatus according to claim 2, further including at least two pressing chambers (42) disposed between said star feeders and said packaging turret.

4. The apparatus according to claim 2, wherein said distributor means comprises a chambered wheel, said portion chambers (28, 29) forming the chambers of said chamber wheel, whereby by rotating the chamber wheel into one or other other direction of two directions, one measured portion each can be fed to one or the other of a cell pair of said two star feeders.

5. The apparatus according to claim 4, wherein said chamber wheel (22) is generally cylindrical in shape consisting of two circular lateral discs (24, 25) and, arranged between them in a crosswise wall (26), a radial wall (27) at a right angle to the crosswise wall, and a side wall at least partially open in the vicinity of said chambers, the radial wall separating two portion chambers (28, 29) from each other.

6. The apparatus according to claim 1, further including a funnel (16) disposed between said distributor means and said conveyor to assist in the transfer of measured portions from the conveyor to the distributor means.

* * * * *